United States Patent [19]

Kline

[11] 4,432,839

[45] Feb. 21, 1984

[54] METHOD FOR MAKING METALLIDED FOILS

[75] Inventor: George A. Kline, Madison, Ohio

[73] Assignee: Diamond Shamrock Corporation, Dallas, Tex.

[21] Appl. No.: 274,822

[22] Filed: Jun. 18, 1981

[51] Int. Cl.[3] ..... C25D 1/04; C25D 3/66; C25D 5/10

[52] U.S. Cl. ..... 204/12; 204/37 R; 204/38 B; 204/39; 204/40; 204/43 R; 204/146

[58] Field of Search ..... 204/12, 37 R, 39, 43 R, 204/40, 38 B, 146

[56] References Cited

U.S. PATENT DOCUMENTS

| | | | |
|---|---|---|---|
| Re. 25,630 | 8/1964 | Cook | 204/39 |
| 2,093,406 | 9/1937 | Atkinson | 204/39 |
| 2,970,091 | 1/1961 | Hanink | 204/39 |
| 3,024,175 | 3/1962 | Cook | 204/39 |
| 3,024,176 | 3/1962 | Cook | 204/39 |
| 3,232,853 | 2/1966 | Cook | 204/39 |
| 3,479,158 | 11/1969 | Cook | 29/194 |
| 3,479,159 | 11/1969 | Cook et al. | 29/194 |
| 3,489,536 | 1/1970 | Cook | 29/194 |
| 3,489,537 | 1/1970 | Cook | 24/194 |
| 3,489,538 | 1/1970 | Cook | 29/194 |
| 3,489,539 | 1/1970 | Cook | 29/194 |
| 3,489,540 | 1/1970 | Cook | 29/194 |
| 3,489,659 | 1/1970 | Cook et al. | 204/39 |
| 3,514,272 | 5/1970 | Cook | 29/194 |
| 3,693,236 | 9/1972 | Kapell et al. | 204/12 X |
| 3,779,872 | 12/1973 | Bomberger, Jr. | 204/12 |
| 3,814,673 | 6/1974 | Cook | 204/39 |
| 3,859,176 | 1/1975 | Shang | 204/12 |
| 3,864,221 | 2/1975 | Ramqvist et al. | 204/39 X |
| 3,958,984 | 5/1976 | Fountain | 204/146 X |

OTHER PUBLICATIONS

221 Scientific American 38, (Aug. 1969).

1 Electrodeposition and Surface Treatment, 189 (1972).

4 Protection of Metals, 89 (1968).

Electrolytic Methods for Producing Titanium and Titanium Alloys, Report of Investigations 6875, U.S. Dept. of Interior(Bureau of Mines, 1966).

Proceedings of the Tenth Lithuanian Conference of Electrochemists, p. 77 of the Israeli Translation made in Jerusalem, (1970).

8 Surface Technology, 371 (1979), Theories of Alloy Deposition: A Brief Survey.

*Primary Examiner*—G. L. Kaplan

*Assistant Examiner*—Nam X. Nguyen

*Attorney, Agent, or Firm*—Woodrow W. Ban; Bruce E. Harang

[57] ABSTRACT

A method for producing interdiffused or metallided films upon a substrate, strippable from the substrate. The alloy films of the instant invention, though brittle, can be handled readily following electrodepositing upon the substrate from a fused salt electrolysis bath.

14 Claims, No Drawings

METHOD FOR MAKING METALLIDED FOILS

TECHNICAL FIELD

This invention relates to the formation of metal alloy films. More particularly, this invention relates to electrodeposition of metal alloy films and specifically to electrodeposition of interdiffused metal alloy films.

BACKGROUND OF THE INVENTION

It has long been known that one metal can be deposited upon the surface of a second metal substrate to give the second metal many of the surface characteristics of the depositing metal. Usually deposited by electrodeposition from ionic aqueous solutions of salts of the depositing metal, such coatings generally are adhered to the surface of the substrate with little if any penetration of the coating metal into the substrate metal or vice versa.

Often a surface coating having attributes such as corrosion resistance or surface hardness associated with alloys of either the substrate and the depositing metal or of two metals to be deposited upon the substrate may be desirable. One difficulty in depositing alloys by simultaneous electrodeposition of two metals from aqueous solution lies in controlling the stoichiometry of the resulting alloy due to differing activities of the metals being deposited.

Recent developments have established electrodeposition from generally anhydrous, molten salt baths as a suitable method for forming on a metal substrate an alloy surface of the substrate metal and at least one additional metal. By these methods, the metal substrate is immersed in a generally anhydrous, molten alkali or alkaline metal halide electrolysis bath containing a halide salt of the metal to be deposited and an electrode including the metal to be deposited. A controlled, generally quite low electrical current per unit surface area of the substrate is passed between the substrate and the electrode with the electrolysis bath at greater than 500° C. and generally greater than 700° C. The electrical current flows at generally a sufficiently low rate so that at least a considerable portion of depositing metal interdiffuses with the substrate metal at the surface of the substrate. This deposition process has come to be known as metalliding and is shown and described in U.S. Pat. No. 3,479,159 and is discussed at 221 Scientific American 38 (1969).

It is generally recognized in metalliding that the molten salt electrolysis bath should be free of carbon, its derivatives, oxygen and metal oxides.

Formation of metal films by electrodeposition from aqueous solutions including the metal upon a substrate from which those films may later be removed for further use is known. Attempts to deposit alloy films from aqueous electrolysis baths have met with disappointing results, principally due to difficulties in controlling stoichiometry of the resulting alloy due to differing activation of the metals being electrodeposited. Where substantial interdiffusion occurs between depositing metal and the substrate, resulting films are generally quite difficult to separate from the substrate in a condition for further use.

DISCLOSURE OF THE INVENTION

The present invention provides a method or process for forming or applying an interdiffused metal alloy coating or film to a substrate. By the method, a conductive substrate is coated with a first metal. A second metal is then electrodeposited to the first metal coated substrate. Electrodeposition occurs under impetus of a measurable or controllable electrical current. The electrical current is of a magnitude so that substantial interdiffusion occurs between the depositing metal and the first metal coating during deposition. Careful selection of a suitable substrate substantially precludes interdiffusion between the metals and the substrate. A sufficiently elevated temperature must be maintained during deposition to promote effective interdiffusion of the depositing metal with the metal coating the substrate.

The resulting metal coating or film upon the substrate is an interdiffused alloy of the first and second metals. By careful control of the electrical current intensity and duration, stoichiometry of the coating can be controlled to produce desired alloy properties.

In a preferred embodiment, the resulting coating is strippable from the substrate for subsequent use elsewhere. For the coating or film to be strippable, interdiffusive effects between both of the alloying metals and the substrate should be negligible. For strippable coatings or films, generally nonmetallic substrates are most appropriate as being less likely to interdiffuse with metal coatings; however, certain metals are available for use as substrates for strippable coatings.

Elevated temperatures generally are required for implementing the interdiffusion advantages of the present invention. Interdiffusion is also substantially enhanced where there is an absence of hydrogen ions. Plating baths or electrolysis cells utilizing molten or so-called fused salt electrolytes are preferred. Fused salts provide generally anhydrous electrolytes capable of being heated to 1000° C. or more.

Alloy foils stripped from a substrate in accordance with the instant invention find application in aerospace, electronics and elsewhere. Metal alloy substrate coatings made in accordance with the instant invention provide substrate surfaces offering enhanced surface properties such as hardness or electrocatalytic activity and suitable for use in such diverse applications as bearing and electrolytic cell electrodes.

The above and other features and advantages of the instant invention will become more apparent when considered in conjunction with the detailed description and working examples forming a part of the specification.

BEST EMBODIMENT OF THE INVENTION

The present invention provides a method or process for applying or forming a metal alloy film or coating to a conductive substrate. The substrate is first coated with one metal component of the alloy, after which one or more additional metal components of the alloy are electrodeposited upon the coated substrate. Electrodeposition occurs at a very low current density as measured at the coated surface and at a substantially elevated temperature. The low current density and elevated temperature foster interdiffusion between the first and subsequent metals as those additional metals are electrodeposited.

Metals coating the substrate are selected for desired alloy properties producible using those metals in the final film or coating. However, metals alloyed using the method of the instant invention should possess the characteristics of forming solid solutions or intermetallic compounds, one with the other, and of relatively rapidly diffusing, one through the other, to achieve the state of solid solution or intermetallic compound.

A solid solution is a homogeneous crystalline phase composed of at least two distinct chemical species occupying lattice or interlattice points within a crystalline structure at random. These solutions, for a given species pair, can exist in a range of species concentration.

Intermetallic compounds, also known by the terms Hume-Rothery or electron compound, are alloys of usually two metals wherein a progressive change in composition of the alloy is accompanied by a progression of phases, each phase, generally differing in crystalline structure.

Generally in these solid solution or intermetallic compounds, hereinafter called alloys or interdiffused alloys for convenience, one of the component metals is possessed of a somewhat greater activity as manifested by a corresponding activity coefficient than the other metal. This more active metal is generally applied second.

Substrates for coating using the instant invention generally should be electrically conductive. Some, such as boron, may be relatively electrically nonconductive at room temperatures but quite conductive at the elevated temperatures at which the instant invention is practiced. The substrate may be a metal, nonmetallic such as graphite or may possess substantial metal characteristics such as silicon. In the substrates having metallic characteristics, from time to time, one of the metals being deposited may tend to alloy with the substrate. Where the coating or film is to be removed from the substrate for subsequent use, it is important that interdiffusional and other forces or effects tending to bond the substrate to the deposited metal film or coatings be relatively insignificant to facilitate removal of the film.

Where significant alloying potential exists between a substrate and one or more of the metals to be applied to the substrate as an alloyed coating, it may be necessary to select an alternate conductive substrate. However, where the rate of diffusion of coating metals into the substrate to form an alloy is substantially slower than the rate of diffusion of the coating metals one into another to form an alloy, the substrate may be effectively utilized in the practice of the instant invention. Rates of diffusion to form alloys between a coating metal and a substrate and between coating metals vary with temperature, current, and the particular materials in question. Therefore when selecting a suitable substrate for use with desired coating metals to be alloyed, careful evaluation of the interdiffusional properties of each material with the others is required.

Suitable conductive substrates for the practice of the instant invention include boron, molybdenum, silicon, tungsten and niobium. Much preferred is graphite for its low cost and substantial tendency to form interdiffused alloys with many coating metals only quite slowly, if at all. Other suitable or conventional electrically conductive substances can be utilized as substrates for practicing the instant invention, such as ceramics having conductive properties and metals or alloys either tending not to alloy with materials being coated or tending to form such alloys only slowly. Depending upon the metals being coated, other potentially suitable substrates include technetium, rhenium and the platinum group metals which include platinum, ruthenium, rhodium, iridium, osmium and palladium.

Typical metals useful in forming the alloy coatings of the instant invention upon the substrate include: lithium, magnesium and beryllium; the Periodic Table Group 3A metals boron, aluminum, scandium, yttrium; the Periodic Table Group 4B metals titanium, zirconium and hafnium; the Group 5B metals vanadium, niobium and tantalum; chromium, manganese, iron, cobalt, nickel, copper, zinc, silicon, indium, germanium and tin. Further, it is believed that phosphorous, antimony, thallium, lead, bismuth, the lanthamide series metals and the actinide series metals are suitable for use as coating metals in the instant invention.

One metal of the desired interdiffused alloy is applied to the substrate. Application of this first metal can be in any suitable or conventional manner such as by painting, spraying, hot dipping, or preferably, electrodeposition, generally from an aqueous electrolyte containing the metal but equally by deposition from a fused salt electrolysis bath. Generally, the desired final stoichiometry of metals in the coating alloy will be known so that a known quantity of the first metal can be applied per unit area of the substrate. The second, and any subsequent metals to be included in the coating alloy, can then be applied in a known quantity to produce a substrate coating or film having the desired stoichiometry.

The second metal is applied using electrodeposition at an elevated temperature. Generally at least 454° C. is required and a temperature greater than about 700° C. is generally preferable. Upon occasion, and depending upon the metals being alloyed, as well as upon the substrate, a temperature as great as 1100° C. may be required.

Such elevated electrodeposition temperatures are not generally realizable using more conventional aqueous electrolytes. Further, hydronium ions adjacent sites of electrodeposition can interfere with electrodeposition of the alloy metals and interdiffusion between the deposited metals of the alloy coating. Therefore, the method of the instant invention is practiced generally using an electrolytic bath or electrolysis bath comprising fused or molten salts.

The salts generally preferred for use in the practice of the instant invention are halide salts of Periodic Table Group I and II metals. The Group I or alkali metals are lithium, sodium and potassium, preferred in the practice of this invention, and rubidium, cesium, and francium. The Group II or alkaline earth metals are magnesium, calcium, strontium and barium, generaly preferred in practicing the instant invention, and radium. Beryllium salts are generally not as suitable for use in an electrolysis bath for the practice of the instant invention except where used to provide ions of beryllium for electrodeposition.

Any halide, fluorine, chlorine, bromine or iodine can be used in the electrolysis bath salts for practicing the instant invention. Fluorine and, to a lesser extent, chlorine are much preferred in practicing the instant invention as they provide a fluxing action during deposition of metals in the electrolysis bath. Mixtures of the alkali and alkaline earth metal halide salts will produce satisfactory results in the practice of the instant invention.

The fused salt or molten electrolyte should also contain a halide salt of the metal being electrodeposited. The salt can be present in any quantity from a trace amount to saturation of the fused salt electrolyte with the salt of the metal being deposited. It is preferred, however, that halide salt of the metal being electrodeposited be present in the fused salt electrolyte in a concentration of between about 5 and 15 at percent. The concentration preferred varies within this range partly as a function of the metals being electrodeposited and the other salts present in the fused salt electrolyte.

The nature of the fused electrolysis bath to some extent also determines the lower operating temperature available for carrying out the instant invention. Some halide salt mixtures such as flinak, a eutectic mixture of lithium, potassium, and sodium fluoride salts, become molten at a temperature as low as 454° C., while others remain crystalline until reaching a considerably more elevated temperature. Some operational parameters of the instant invention, such as the electrical conductivity of the substrate and the rate of interdiffusion between the coating metals and between the coating metal and the conductive substrate, often depend in part upon the temperature at which the process of the instant invention is operated. Selection of a suitable operational electrolysis bath temperature is, therefore, of some import. Preferably, the electrolysis bath is maintained at a temperature of at least 700° C., but not in excess of 1100° C.

The current density measured at the coated surface of the conductive substrate is of considerable importance in the practice of the instant invention. The conductive substrate is generally arranged within the electrolysis bath to be cathodic, connected to a source of electrical current. Current density at the cathodic coated substrate surface should be sufficiently low to permit cations depositing upon the coated substrate surface to interdiffuse into the coating metal without building a substantial discreet electrodeposit atop the substrate coating. For virtually all metals useful as alloying metals for electrodeposition on the coated substrate, this current density is less than 100 milliamperes per square centimeter of coated substrate surface. For most typical substrates, this current density is between about 1 and 20 milliamperes per square centimeter.

The actual current density used in applying particular metals to form an alloyed substrate coating or film will be a variable, dependent in part upon the particular metals, the temperature and composition of the electrolysis bath and the substrate. Generally when electroapplying an alloying metal to the coated substrate, if application of the electrical potential associated with the electrical current source is discontinued, the cathode should remain positive indicating that electrodiffusion of the depositing metal into the metal coating is proceeding generally apace with electrodeposition. Where the cathode does not remain positive, electrodeposition has proceeded too rapidly, building a layer of the alloying metal a top the substrate coating metal. Electrical current density at the conductive substrate, if then reduced, should permit interdiffusion of the alloyed coating metals without formation of a top coating of the metal being electrodeposited.

Metal for electrodepositing is preferably supplied from an electrode made anodic to the coated substrate by attachment to the electrical current source. This anode is generally fabricated to include the metal being deposited or a compound including the metal. It should be noted, however, that where ions of the metal being electrodeposited are present in the molten, or fused salt electrolysis bath, these metals need not be included in the anodic electrode to enable the practice of the instant invention.

It is not necessary that an electrical current be impressed between the conductive substrate and an electrode within the electrolysis bath. Where the metal coating and an alloying metal present in the electrolysis bath interdiffuse relatively readily, and where the alloying metal present in the electrolysis bath is more active than the metal coating the conductive substrate, then making a connection external to the electrolysis bath between the conductive substrate and an electrode within the electrolysis bath forms a dischargable galvanic cell. Alloying metal ions will interdiffusionally deposit upon the substrate coating to alloy with the coating metal. Absent an impressed electrical current, however, this interdiffusional alloying proceeds slowly, generally at about $\frac{1}{3}$ to 1/10 of the rate available using an electrical current externally applied.

Using an external electrical current to cause interdiffusional alloying, it is possible to control fairly precisely stoichiometry of the resulting alloy on the conductive substrate. A particular current intensity, for a given depositing metal, will deposit the metal at a particular rate calculable in units of metal weight per hour. Control of stoichiometry, where the weight of metal coating the substrate prior to electrodeposition is known, is accomplished by discontinuing electrodepostion when a desired alloying metal deposit stoichiometry has been completed.

Where no or minor interdiffusion has occured between the conductive substrate and the alloyed coating upon the substrate, the coating may be removed to produce an alloy film. Removal or stripping can be accomplished in any suitable or conventional manner such as by application of mechanical force to the coating followed by peeling of the coating from the substrate. Alternately, the substrate can be dissolved or leached from the coating.

Films made according to the instant invention can be of any desired thickness, including quite thin films of brittle alloy metals. Resulting films can be used for applications as diverse as sheeting for areospace uses and electrolytic cell electrode coatings.

The following examples are offered for consideration in understanding the present invention and certain of its preferred aspects.

EXAMPLE 1

A 1 kilogram melt of a ternary eutectic mixture of sodium, lithium and potassium fluorides was contained in a vacuum sealable crucible. The fluoride salt melt eutectic mixture, known as flinak, melts at a temperature lower than other mixtures of the three salts. $K_2TiF_6$ in an amount of 10 percent by weight of the melt was added to the flinak. The $K_2TiF_6$ appeared to react with the titanium vessel to impart a purplish cast to the eutectic mixture characteristic of Ti in the +3 valance state. A vacuum to 1 millimeter of mercury pressure was impressed upon the crucible and its contents. A $\frac{1}{4}''$ diameter graphite rod was suspended in the crucible and immersed in the flinak, introduction into the crucible being effected via an airlock. The graphite rod included a nickel coating that had been applied by electrodeposition. The nickel plated graphite rod was made cathodic to the crucible and the eutectic mixture was heated to about 700° C. Current flow between the anodic Ti crucible and cathodic graphite rod was controlled to be at 12 milliamperes per square centimeter of graphite rod nickel plated surface for 1 hour.

X-ray diffractive analysis of the resulting interdiffused nickel-titanium coating upon the graphite rod revealed nickel and titanium uniformly present in the coating in a ratio of generally 1 to 2 stoichiometric parts, generally as $NiTi_2$. Some excess titanium was located in the interdiffused coating.

EXAMPLE 2

One kilogram of the lithium, sodium, potassium eutectic mixture of Example 1 also containing 10 percent by weight $TiF_3$ was introduced into a titanium crucible having a 3 inch inside diameter. A ¼ inch diameter graphite rod was coated with copper using a combination of electroless and galvanic plating. The eutectic mixture was heated to 815° C. under a helium inerted atmosphere, and the copper plated graphite rod was introduced into the crucible and immersed in the eutectic mixture. The graphite rod was made cathodic to the crucible, and current was passed between them at 10 milliamperes per centimeter squared of coated graphite rod surface for 150 minutes.

An interdiffused coating of copper-titanium alloy resulted upon the graphite rod. The coating was stripped from the substrate graphite rod using steel forceps. X-ray diffraction of the stripped coating revealed intermetallic CuTi and $TiCu_4$ phases with some excess copper metal. The strippable coating averaged 0.003 inch in thickness.

EXAMPLE 3

A boron substrate chip of between about 98 and 99.5 percent purity is electroplated with copper in the eutectic mixture of Example 1 containing 10 percent by weight of $CuF_2$. The boron chip is made cathodic to a copper ¼ inch rod, both being suspended within a 3 inch inside diameter Ti crucible inerted using helium. The copper, being substantially insoluable in boron, plates only on the boron chip surface. Tin is then applied to the copper coated boron chip in a second fused salt bath containing the eutectic mixture of Example 1 and 10 percent by weight of tin fluoride. In this second bath, the boron chip is made cathodic to a tin rod suspended in the tin fluoride containing electrolysis bath, a current of 5 milliamperes per squared centimeter of coated boron chip surface flowing between them. An interdiffused tin-copper alloy coating of the boron chip results. At low temperature, below about 100° C., the copper-tin coated boron chip is electrically relatively nonconductive except through the coating; at more elevated temperatures, both the boron chip and the alloy coating are conductive. The example is repeated for zinc and for lead in lieu of the tin. Zinc and lead fluorides are substituted for tin fluorides in the electrolysis bath.

EXAMPLE 4

Copper is deposited upon a ¼" diameter tungsten rod by electrolytic deposition from an aqueous solution of copper sulfate. The copper plated rod is then immersed in a fused salt electrolyte bath including the eutectic mixture of Example 1 and 10 percent by weight of zinc fluoride. Made cathodic to a zinc rod immersed in the electrolysis bath, the copper coated rod is subjected to electrodeposition of zinc at 8 milliamperes per square centimeter of tungsten rod. An alloyed copper-zinc coating of the tungsten rod results, that includes no substantial interdiffusional metal interaction with the tungsten substrate.

EXAMPLE 5

A ¼" molybdenum rod is coated with copper as in Example 4. The coated rod is then immersed in the eutectic electrolysis fused salt bath of Example 1 including 10 weight percent tin fluoride. Made cathodic to a tin rod immersed in the electrolysis bath, the copper coated rod is electrodeposited with tin at a 5 milliampere current per square centimeter. A copper-tin alloy results on the molybdenum rod having substantially no interdiffusional interaction with the substrate molybdenum.

While a preferred embodiment of the invention has been described in detail, it will be apparent that various modifications or alterations may be made therein without departing from the scope of the invention as set forth in the appended claims.

What is claimed is:

1. A process for applying an interdiffused metal coating to a conductive substrate selected from the group of boron, molybdenum, silicon, tungsten, niobium, graphite, technetium, rhenium, the platinum group metals, electrically conductive ceramics and mixtures thereof comprising the steps of:

applying a base metal coating to the substrate;

applying a second metal to the coated substrate using a measurable quantity of electrical current at a rate temperature to produce interdiffusion between the base metal and the second metal but not between the substrate and the metals.

2. A method for producing metal alloy foil comprising the steps of:

applying to an electrically conductive substrate a coating of a base metal;

applying at least partially under impetus of a measurable electrical current, a coating of a second metal at a temperature and an electrical current flow rate whereby substantial interdiffusion occurs between the coating metals but not between the coating metals and the substrate; and stripping the resulting interdiffused metal coating from the substrate.

3. A method for making a metal alloy foil of a first metal and a second more active metal comprising the steps of:

coating an electrically conductive substrate with a desired quantity of the first metal;

electrodepositing the second metal upon the coated conductive substrate at a temperature and under an electrical current density whereby substantial interdiffusion between the coated first metal and the depositing second metal is induced until a desired quantity of the second metal has been deposited; and stripping the resulting alloy foil from the conductive substrate.

4. The method of claim 3 wherein the temperature exceeds 454° C. and the current density at coated surface portions of the coated substrate does not exceed 100 milliamperes per square centimeter.

5. The method of either of claims 3 and 4 wherein electrodeposition is conducted in an environment essentially free of oxygen or metal oxides.

6. The method of claim 5 wherein electrodeposition is conducted in a nonaqueous electrolysis bath of alkali metal halide and halide salt of the more active second metal.

7. A method for making an interdiffused metal coating of a first metal and a second, more active, valve metal upon an electrically conductive substrate selected from the group of boron, molybdenum, silicon, tungsten, niobium, graphite, technetium, rhenium, the platinum group metals, electrically conductive ceramics and mixtures thereof comprising the steps of:

coating the substrate with the first metal; and electrodepositing the valve metal selected from a group consisting of zirconium, titanium, and hafnium metal upon the coated conductive substrate at a temperature and under an electrical current density whereby substantial interdiffusion between the coated first metal and the depositing valve metal is induced until a desired quantity of the valve metal has been deposited.

8. The method of claim 7 wherein the temperature exceeds 454° C. and the current density at coated surface portions of the coated substrate does not exceed 100 milliamperes per square centimeter.

9. The method of either of claims 7 or 8 wherein electrodeposition is conducted in an environment essentially free of oxygen or metal oxides.

10. The method of claim 9 wherein electrodeposition is conducted in a nonaqueous electrolysis bath of alkali metal halide and halide salt of the more active second metal.

11. A process for producing a metal alloy foil comprising the steps of:

applying a coating of a metal to an electrically conductive substrate;

immersing the substrate in an electrolysis bath comprising at least one molten alkali metal halide and a halide salt of a second coating metal;

providing an electrode including the second coating metal;

maintaining the bath at a temperature of greater than about 454° C.;

impressing an electrical current between the substrate and the second metal electrode whereby ions of the second metal become detached from the second metal electrode and deposit upon the substrate, the electrical current being of a magnitude to encourage substantial interdiffusion between the first and second metals in coating the substrate; and stripping the resulting interdiffused coating from the substrate.

12. The method of claim 11 wherein electrical current density at the substrate does not exceed 100 milliamperes per square centimeter.

13. The process of claim 11 wherein the bath is essentially free of oxygen and metal oxides.

14. A process for making an alloy metal foil of a first metal and a more active metal comprising the steps of:

coating a conductive substrate with the first metal;

immersing the coated substrate in a nonaqueous electrolysis bath including at least one alkali metal halide and a halide salt of the more active metal, the bath being at a temperature greater than about 454° C. and the bath being essentially free of oxygen and metal oxides;

impressing an electrical current of not greater than 100 milliamperes per square centimeter of coated substrate surface between the coated substrate and an electrode, the electrode including the more active metal and being immersed in the electrolysis bath;

maintaining the electrical current at a level to cause ions of the more active metal to deposit upon the conductive substrate and substantially interdiffused with the first metal coating until a desired stoichiometric quantity of the more active metal has been deposited; and stripping the resulting alloy metal foil from the substrate.

* * * * *

UNITED STATES PATENT AND TRADEMARK OFFICE

CERTIFICATE OF CORRECTION

PATENT NO. : 4,432,839

DATED : February 21, 1984

INVENTOR(S) : George A. Kline

It is certified that error appears in the above-identified patent and that said Letters Patent is hereby corrected as shown below:

In Column 8, line 21, insert --and-- in front of the word temperature.

Signed and Sealed this

Sixth Day of July, 1993

Attest:

Michael K. Kirk

MICHAEL K. KIRK

Attesting Officer

Acting Commissioner of Patents and Trademarks